United States Patent [19]

Randall

[11] Patent Number: 4,622,156

[45] Date of Patent: Nov. 11, 1986

[54] TANNING OF LEATHER

[75] Inventor: David J. Randall, Slough, England

[73] Assignee: Alcan International Limited, Montreal, Canada

[21] Appl. No.: 719,732

[22] Filed: Apr. 4, 1985

[30] Foreign Application Priority Data

Apr. 10, 1984 [GB] United Kingdom ..... 8409266

[51] Int. Cl.[4] ..... C14C 9/00

[52] U.S. Cl. ..... 252/8.57; 8/94.27; 8/94.29

[58] Field of Search ..... 252/8.57; 8/94.29, 150.5, 8/94.27

[56] References Cited

U.S. PATENT DOCUMENTS

| | | | |
|---|---|---|---|
| 2,707,667 | 5/1955 | Severn | 8/94.29 |
| 2,942,930 | 6/1960 | Luvisi et al. | 8/94.29 |
| 3,180,827 | 4/1965 | Martinek et al. | 8/94.29 |
| 3,690,812 | 9/1972 | Klein | 8/94.29 |
| 3,792,976 | 2/1974 | Erdmann et al. | 8/94.29 |
| 3,822,993 | 7/1974 | Robinson et al. | 8/94.29 |
| 3,950,131 | 4/1976 | Young | 252/8.57 |
| 3,966,402 | 6/1976 | Nebel | 252/8.57 |
| 4,042,321 | 8/1977 | Backer et al. | 252/8.57 |
| 4,264,319 | 4/1981 | Plapper et al. | 8/94.26 |
| 4,327,997 | 5/1982 | Prentiss et al. | 252/8.57 |

OTHER PUBLICATIONS von A. Zissel, "Der Ersatz des Chroms durch Aluminium und andere Gerbstoffe im Hinblick auf Ledercharakter und Gerbstoffbindung".

N. P. Slabbert, "Metal Complexes and Mineral Tanning", Leather Industries Research Institute, Proc. XVI Cong. Int. Union Leather Chem. Technol. Socs.

C. W. Beebe, et al. [J. Am. Leather Chem. Assoc., 52, 560 (1957)], The Use of Acrylates in Aluminum Tanning.

Krawiecki [Proc. XVI Cong. Int. Union Leather Chem. Technol. Socs. I (1975)], Unconventional Method of Chrome-Aluminium Tannage.

*Primary Examiner*—A. Lionel Clingman
*Assistant Examiner*—Willie J. Thompson
*Attorney, Agent, or Firm*—Browdy and Neimark

[57] ABSTRACT

Leather is made by tanning hides and skins in a solution containing chromium to which is added reactive alumina hydrate. A high take-up of chromium and leather having improved properties are obtained.

20 Claims, No Drawings

TANNING OF LEATHER

This invention relates to the use of reactive alumina hydrate in the tanning of animal skins and hides using chromium compounds to make leather.

When leather is tanned by the chrome process, animal hides (the term "hide" herein includes both hides and skins), after preliminary treatment generally comprising dehairing, liming, deliming and bating, are pickled in a mildly acid aqueous medium and then treated with an aqueous solution containing a chromium compound such as basic chromium sulphate. During this treatment the chromium compound is absorbed by the hide and profoundly modifies the properties of the hide to produce leather having various desirable characteristics including resistance to shrinkage at elevated temperatures. The pH value of the chromium containing solution has an important influence on the tanning process and the optimum end pH value is normally from 3.5 to 4.5.

At higher pH values precipitation of water-insoluble chromium compounds takes place and at lower pH absorption of the chromium compound is inhibited so that even after prolonged treatment with the chromium-containing solution, a large amount of the chromium compound is unabsorbed and remains in the solution. Such retention of chrome values in the solution not only increases the cost of the tanning process itself but also creates a serious problem in disposing of the effluent discharged after tanning is complete. A large volume of effluent containing dissolved chromium is a serious pollutant.

In the conventional chrome tanning process, the pH value of the chromium-containing solution is normally adjusted by addition of a base, such as sodium carbonate or magnesium oxide. Exact control of the pH value of the tanning solutions is quite difficult and, to avoid the risk of the pH value rising to a level at which precipitation of insoluble chromium compounds occurs, the pH is commonly maintained at a value of 3.3 to 3.8 typically leaving some 30% of original chrome still in solution.

It is known that solutions of aluminium salts such as alum have certain leather-tanning properties. Aluminium tannage requires very low initial pH and large quantities of neutral salt to repress both swelling and rapid flocculation of aluminium salts as the pH is raised. This type of tannage leads to leathers that tend to dry out and to become hard and horny unless much salt is used; even then the leather tends to feel flat and papery. Aluminium tannage has been used in combination with other tannages.

N. P. Slabbert (Proc. XVI Congr. Int. Union Leather Chem. Technol. Socs. I 240 (1975) mentions Mimosa pre-tannage followed by aluminium tannage. C. W. Beebe et al (J. Am. Leather Chem. Assoc. 52 560 (1957) mentions combined tannage with water-soluble aluminium salts and polyacrylates. Krawiecki (Proc. XVI Cong. Int. Union Leather Chem.Technol. Socs. I (1975) mentions mixed tanning using chromium sulphate, water-soluble aluminium sulphate and formates.

U.S. Pat. No. 4,264,319 describes a tanning process in which uncured hides are subjected to the action of an aqueous liquor containing; (i) a water insoluble aluminosilicate of a certain formula, particle size and calcium binding power and (ii) certain carboxylic acids containing ester and/or urethane and/or amide groups; as partial replacements for conventional tanning or pretanning agents.

According to the invention there is provided a method of tanning skins and hides which comprises treating the skin or hide with an aqueous solution of a chromium compound, characterised in that a reactive alumina hydrate is added to the solution.

A "reactive alumina hydrate" is a hydrate of alumina capable of dissolving in aqueous solutions having a pH value of about 3 at temperatures below 50° C. to neutralise some of the acidity and increase the pH value. The reactive alumina hydrates are generally amorphous or poorly crystallised.

It is found that well crystallised alumina hydrates, such as the alumina trihydrate Gibbsite, obtained from the Bayer Process, are not reactive.

Reactive alumina hydrates may be made by several methods, including neutralising aqueous solutions of aluminium salts (such as the chloride, nitrate or sulphate) with a solution of a basic compound such as sodium aluminate, sodium carbonate or aqueous ammonia to yield a precipitated alumina hydrate. Another method comprises treating a solution of an aluminate such as sodium aluminate with carbon dioxide, sodium bicarbonate or a mineral acid whereupon a precipitated alumina hydrate is again obtained.

The reactive alumina hydrate may be added to the tanning solution as an aqueous slurry, a moist filter cake or as a powder. The aqueous slurry may contain from 0.1 to 12% by weight of alumina, the filter cake may contain from 2 to 25% of alumina and the powder may contain from 20 to 90% of alumina, all measured as anhydrous $Al_2O_3$.

The pH value of a simple chromium salt such as a basic chromic sulphate suitable for use in leather tanning is about pH 2. When a reactive alumina hydrate is added to the acidic chromium tanning solution it has the effect of increasing the pH of the solution. However it is found that even if the alumina hydrate is added in a large excess the pH value of the solution does not rise above 4.5, so that there is substantially no risk of the pH value rising to a level at which precipitation of chromium compounds occurs.

Tanning may thus be conducted to a relatively high pH value at which take-up of the chromium from the tanning solution is optimised without the need to monitor the pH of the solution continuously.

It is believed that the reactive alumina hydrate, which is insoluble in pure water, dissolves in the acidic tanning solution, which contains proton—donating ionic chromium species, to form water soluble aluminium salts and raise the pH value. The ionic chromium species respond by generating more protons and polymerising until an equilibrium is established between the alumina hydrate and the salts dissolved in the solution. The equilibrium is affected by complex formation between chromium and aluminium species in solution and the collagen of the hide and equilibrium is established at a pH not exceeding 4.5.

It has also been found that at a given pH value, the presence of aluminium salts dissolved in the tanning solution gives better absorption by the hide of chromium species apparently because of formation of complex chromium aluminium-hydroxy ions.

The tanning operation may be carried out by placing the pickled hide in a drum containing tanning solution which is rotated so that the hides are tumbled in the tanning solutions. The concentration of chromium compounds in the tanning solution may be within the range conventionally used in leather tanning, generally from 1 to 50 g/l of chromium measured as chromic oxide $Cr_2O_3$ and the total amount of the chromium present is generally the amount which is to be absorbed by the hide, typically from 0.1 to 7% of the weight of the pickled hide measured as $Cr_2O_3$.

The amount of alumina hydrate which dissolves in the solution is limited by the content of acidic chromium species in the solution. The dissolved aluminium salts formed contribute to the tanning and it is desirable for substantially all the added alumina to dissolve and for the aluminium ionic species formed to be absorbed by the hide. In general, it is desirable to add to the solution a weight of reactive alumina hydrate, measured as $Al_2O_3$ approximately equal to the weight of chrome measured as $Cr_2O_3$. The amount of reactive alumina hydrate added, measured as anhydrous $Al_2O_3$, may be from 0.1 to 10% of the pickled weight of the hide.

The chromium may be added to the solution as a chromium salt such as a basic chromium sulphate. The tanning solution may be at ambient temperature or lukewarm during tanning as in conventional commercial chrome tannages. Tanning may be started with a chromium containing solution containing no aluminium generally at a pH value of about 2 and the reactive alumina hydrate may be added during the process typically about 1 hour after the start of tanning. The chromium is thus absorbed initially at a relatively low pH value and the pH is higher during the later stages of tanning. This method is generally preferred with regard to chrome exhaustion and shrinkage resistance of the product leather. The reactive alumina hydrate may be added stepwise at intervals or in a single addition. "Once shot" addition generally gives a higher final pH and higher chrome and aluminium exhaustions than stepwise addition, but stepwise addition over an extended period gives a more gradual rise in pH and, generally, a leather having higher hydrothermal resistance.

Methods of tanning according to embodiments of the invention will now be described in the following examples given by way of illustration.

EXAMPLE 1

A standard chromium tannage was carried out on six English sheepskins with sodium bicarbonate and a spray dried proprietary basic chromium sulphate. The chrome offer was set at 1% $Cr_2O_3$.

Six degreased and pickled sheepskins (4.15 kg) were drummed in 4.15 $dm^3$ water containing 166 g basic chromium sulphate (25% $Cr_2O_3$, 33% basicity); drumming was continued for one hour at a constant 40° C.

Aliquots of sodium bicarbonate ("AnalaR") were added over the next five hours drumming to a total of 80 g. The pH at the end of the first hour was 2.0 and the final pH was 3.7. The liquor was acidified with nitric acid and analysed by atomic absorption spectrometry. An analysis of 1.3 $gdm^{-3}$ $Cr_2O_3$ was obtained corresponding to 87% chrome exhaustion.

A mixed chromium-aluminium tannage was carried out as follows with offers of 1% $Cr_2O_3$ and 1% $Al_2O_3$.

Six degreased and pickled sheepskins (4.45 kg) were drummed for one hour in 4.45 $dm^3$ water containing 178 g basic chromium sulphate (25% $Cr_2O_3$, 33% basicity) at a constant 40° C. Reactive alumina hydrate, spray dried proprietary product (B.P. F1500 standard) 89 g (50% $Al_2O_3$), was added and drumming continued at 40° C. for a further five hours. At the end of the first hour pH was 2.0, after 6 hours this had risen to 3.9.

The exhausted liquor was analysed as above and found to contain 0.08 $gdm^{-3}$ $Cr_2O_3$ and 0.69 $gdm^{-3}$ $Al_2O_3$ corresponding to chrome and alumina exhaustions of 99.2% and 93.1% respectively.

EXAMPLE 2

A mixed chromium-aluminium tannage was carried out on English sheepskins as follows with offers of 1% $Cr_2O_3$ and 1% $Al_2O_3$.

Six degreased and pickled sheepskins (4.6 kg) were drummed for one hour in 4.6 $dm^{-3}$ water containing 185 g basic chromium sulphate (25% $Cr_2O_3$, 33% basicity) at a constant 40° C.

Reactive alumina hydrate, 920 g, was added (5% w/w $Al_2O_3$ aqueous paste prepared by neutralisation of sodium aluminate with aluminium sulphate to pH 7 followed by filtration of 1% $Al_2O_3$ slurry) and drumming continued for five hours at 40° C. After one hour the pH was 2.0, after 6 hours the pH had risen to 3.6.

The exhausted liquor was analysed as described in Example 1 and found to contain 1.1 $gdm^{-3}$ $Cr_2O_3$ and 1.7 $gdm^{-3}$ $Al_2O_3$ corresponding to chrome and alumina exhaustions of 89% and 83% respectively.

EXAMPLE 3

A standard chromium tannage was carried out on six English sheepskins with sodium bicarbonate and a spray dried proprietary basic chromium sulphate. The chrome offer was set at 1.5% $Cr_2O_3$.

Six degreased and pickled sheepskins (4.8 kg) were drummed in 4.8 $dm^3$ water containing 288 g basic chromium sulphate (25% $Cr_2O_3$, 33% basicity); drumming was continued for one hour at a constant 40° C.

Aliquots of sodium bicarbonate ("AnalaR") were added over the next five hours drumming to a total of 80 g. The pH at the end of the first hour was 2.0, the final pH was 3.8. The liquor was analysed as described in Example 1. An analysis of 3.0 $gdm^{-3}$ of $Cr_2O_3$ was obtained corresponding to 80% chrome exhaustion.

A mixed chromium-aluminium tannage was carried out as follows with offers of 1.5% $Cr_2O_3$ and 2.25% $Al_2O_3$.

Six degreased and pickled sheepskins (4.95 kg) were drummed for one hour in 4.9 $dm^3$ water containing 297 g basic chromium sulphate (25% $Cr_2O_3$, 33% basicity) at a constant 40° C. Reactive alumina hydrate, 223 g, was added (spray dried proprietary product 50% $Al_2O_3$, B.P. F1500 standard) and drumming continued for a further five hours at 40° C. After one hour pH was 2.0, after 6 hours 4.1.

The exhausted liquor was analysed as in Example 1 and found to contain 0.02 $gdm^{-3}$ $Cr_2O_3$ and 0.12 $gdm^{-3}$ $Al_2O_3$, corresponding to chrome and alumina exhaustions of 99.9% and 99.2% respectively.

EXAMPLE 4

A mixed-chromium-aluminium tannage was carried out on English sheepskins as follows with offers of 1½% $Cr_2O_3$ and 3% $Al_2O_3$.

Six degreased and pickled sheepskins (5.0 kg) were drummed for one hour in 5 $dm^3$ water containing 300 g basic chromium sulphate.

Reactive alumina hydrate (drum dried powder containing 37% alumina produced by drying 1% $Al_2O_3$ slurry of neutral paste produced as described in Example 2), 405 g, was added and drumming continued at 40°

C. for five hours. After the first hour pH was 2.0, after 6 hours the pH was 3.5.

The exhausted liquor was analysed as in Example 1 and found to contain 0.85 $gdm^{-3}$ $Cr_2O_3$ and 1.9 $gdm^{-3}$ $Al_2O_3$, corresponding to chrome and alumina exhaustions of 93.7%.

EXAMPLE 5

A standard chromium tannage was carried out on six English sheepskins with sodium bicarbonate and a spray dried proprietary basic chromium sulphate. The chrome offer was set at 2% $Cr_2O_3$.

Six degreased and pickled sheepskins (4.5 kg) were drummed for one hour in 4.5 $dm^3$ water containing 360 g basic chromium sulphate (25% $Cr_2O_3$ basicity), at a constant 40° C.

Aliquots of sodium bicarbonate "AnalaR" were added over the next five hours drumming to a total of 90 g.

The pH at the end of the first hour was 2.0 and the final pH was 3.7. The liquor was analysed as described in Example 1. An analysis of 5.1 $gdm^{-3}$ $Cr_2O_3$ was obtained corresponding to 74.5% chrome exhaustion.

A mixed chromium-aluminium tannage was carried out as follows with offers of 2% $Cr_2O_3$ and 2% $Al_2O_3$.

Six degreased and pickled sheepskins (4.9 kg) were drummed for one hour in 4.9 $dm^3$ water containing 392 g basic chromium sulphate (25% $Cr_2O_3$, 33% basicity) at a constant 40° C.

Reactive alumina hydrate, 196 g, was added (spray dried proprietary product, 50% $Al_2O_3$ B.P. F1500 standard) and drumming continued for five hours at 40° C. After one hour pH was 2.0 and the pH after 6 hours was 4.15.

The exhausted liquor was analysed as described in Example 1 and found to contain 0.08 $gdm^{-3}$ $Cr_2O_3$ and 0.67 $gdm^{-3}$ $Al_2O_3$, corresponding to chrome and alumina exhaustions of 99.6% and 96.7% respectively.

The operating conditions and results for Examples 1 to 5 are summarised in Table 1.

TABLE 1

| EXAMPLE NO. | OFFER (%) $Cr_2O_3$ | OFFER (%) $Al_2O_3$ | REACTIVE ALUMINA HYDRATE | pH 1 HOUR | pH 6 HOURS | EFFLUENT ($g \cdot dm^{-3}$) $Cr_2O_3$ | EFFLUENT ($g \cdot dm^{-3}$) $Al_2O_3$ | EXHAUSTION % $Cr_2O_3$ | EXHAUSTION % $Al_2O_3$ |
|---|---|---|---|---|---|---|---|---|---|
| 1 | 1 | 0 | — | 2.0 | 3.7 | 1.3 | — | 87 | — |
| 1 | 1 | 1 | SPRAY DRIED | 2.0 | 3.9 | 0.08 | 0.69 | 99.2 | 93.1 |
| 2 | 1 | 1 | PASTE | 2.0 | 3.6 | 1.1 | 1.7 | 89 | 83 |
| 3 | 1½ | 0 | — | 2.0 | 3.8 | 3.0 | — | 80 | — |
| 3 | 1½ | 2¼ | SPRAY DRIED | 2.0 | 4.1 | 0.02 | 0.12 | 99.9 | 99.2 |
| 4 | 1.5 | 3 | DRUM DRIED | 2.0 | 3.5 | 0.85 | 1.9 | 93.7 | 93.7 |
| 5 | 2 | 0 | — | 2.0 | 3.7 | 5.1 | — | 74.5 | — |
| 5 | 2 | 2 | SPRAY DRIED | 2.0 | 4.15 | 0.08 | 0.67 | 99.6 | 96.7 |

Examples 6 to 12 below were carried out at a commercial tannery.

The operating conditions and results for Examples 6 to 12 are summarised in Table 2. Shrinkage temperatures and boil tests, where quoted are based on the test methods specified in British Standard 3144 1968 p. 52, p. 56 save that for shrinkage temperatures (Ts) above 100° C. a bath of paraffin oil was used to heat the wet leather.

TABLE 2

| Ex No. | Offer % $Cr_2O_3$ | Offer % $Al_2O_3$ | pH 1 HR | pH 6 HR | Effluent $gdm^{-3}$ $Cr_2O_3$ | Effluent $gdm^{-3}$ $Al_2O_3$ | Exhaustion % $Cr_2O_3$ | Exhaustion % $Al_2O_3$ | Ts °C. | Passed Boil Test B.S. 3144 |
|---|---|---|---|---|---|---|---|---|---|---|
| 6 | 1.5 | 1.9 | 2.7 | 3.6 | 0.34 | 1.04 | 95 | 89 | >100 | |
| 7 | 1.25 | 1¼ | 2.3 | 3.5 | 0.64 | 0.44 | 92 | 95 | >100 | |
| 8 | 1.25 | 0.83 | 2.1 | 3.5 | 0.13 | 0.86 | 98.4 | 90 | >100 | x |
| 9 | 1.25 | 0.83 | 3.0 | 3.4 | 0.63 | 0.59 | 89 | 80 | >100 | x |
| 10 | 1.25 | 0.83 | 2.2 | 3.3 | 0.21 | 0.69 | 96 | 77 | 99 | x |
| 11 | 1.25* | 0.83* | 3.2 | 4.0 | 0.35 | 0.40 | 96 | 93 | 98 | x |
| 12 | 1.25+ | 0.83+ | 3.2 | 3.8 | 0.9 | 1.51 | 89 | 73 | >100 | |
| 13 | 1.5 | — | 2.0 | 3.85 | 1.2 | — | 92 | — | 100 | x |
| 13 | 1.5 | 1.4 | 2.0 | 3.4 | 1.6 | 93 | 89 | 93 | 111 | |

*Lime split bovine hides offers based on pickled weights
+ Lime split bovine hides offers based on limed weights

EXAMPLE 6

Six English sheepskins (weight 4.75 Kg) pickled and degreased, were drummed in a 200% float of 570 g Na Cl and 9.5 $dm^3$ tap water at 25° C. for ten minutes. After drumming the liquor pH was 2.7.

A proprietary formate masked basic chromium sulphate liquor (15% w/w $Cr_2O_3$, 33% basicity, formate/Cr=1), was added at 1½% $Cr_2O_3$ offer, 475 g. Drumming continued for 130 minutes.

Reactive alumina hydrate was added at ½ hour intervals in ten 52 g aliquots and drumming continued; the reactive alumina hydrate as in the form of a 13.4% w/w $Al_2O_3$ paste prepared by neutralisation of sodium aluminate with aluminium sulphate to pH 7 followed by filtration of 1% $Al_2O_3$ slurry. During addition of the aluminium reagent the liquor temperature was gradually raised from 25° C. to 40° C.

The system was left drumming overnight without heat with a further 140 g of reactive 13.4% w/w $Al_2O_3$ paste offer of reactive alumina hydrate.

Final pH was 3.6, leather was obtained with a shrinkage temperature above 100° C. which passed a 2 minute boil test according to British Standard 3144. The exhausted liquor was analysed as described in Example 1 and found to contain 0.34 $gdm^{-3}$ $Cr_2O_3$ and 1.04 $gdm^{-3}$ $Al_2O_3$ corresponding to chrome and alumina exhaustions of 95% and 89% respectively.

The skins were neutralised, dyed, fat-liquored and pole dried in a conventional manner to produce firm, tight leather with flat grain and good tight suede.

EXAMPLE 7

Forty eight English sheepskins (weight 30 Kg) pickled and degreased, were drummed in a 150% float of 6% brine for 10% minutes. After drumming the liquor pH was 3.0.

A proprietary spray-dried sulphate masked basic chromium sulphate powder (25% $Cr_2O_3$, 33% basicity), 1.5 Kg was added and drummed in for 1 hour (1.25% chrome offer). During this time the temperature was increased from 20° C. to 32° C. and the pH fell to 2.3.

1.4 Kg of reactive alumina hydrate (13.4% $Al_2O_3$ as in Example 6) was added and drumming continued for forty minutes. A further 1.4 Kg of reactive alumina hydrate was added making a total $Al_2O_3$ offer of 1.25%, and drumming continued for a further six hours at a thermostatted 40° C. Drumming was continued overnight without heat and after 24 hours tanning, the liquor pH was 3.5 and temperature 25° C. Leather was obtained with a shrinkage temperature above 100° C. which passed the 2 minute boil test. The exhausted liquor was analysed as described in Example 1 and found to contain 0.64 $gdm^{-3}$ $Cr_2O_3$ and 0.44 $gdm^{-3}$ $Al_2O_3$ corresponding to chrome and alumina exhaustions of 92% and 95% respectively.

The skins were washed, neutralised, dyed and fat liquored to produce less firm leather than Example 6 with flat grain and good tight suede.

EXAMPLE 8

Six English sheepskins (weight 4.0 Kg) degreased and pickled, were drummed in a 150% float of 6% brine for 15 minutes. After drumming, liquor pH was 2.4.

A proprietary sulphate masked basic chromic sulphate powder (25% $Cr_2O_3$, 33% basicity) 200 g, was added and drummed in for 1 hour.

Reactive alumina hydrate, 140 g, (12% $Al_2O_3$ prepared as in Example 6) was added making an alumina offer of 0.83%.

Drumming was continued and the temperature gradually raised over 2½ hours to 35° C., drumming was continued overnight without heat and after 24 hours tanning, the liquor pH was 3.5.

Leather was obtained with a shrinkage temperature above 100° C. The exhausted liquor was analysed as in Example 7 and found to contain 0.13 $gdm^{-3}$ $Cr_2O_3$ and 0.86 $gdm^{-3}$ $Al_2O_3$. Corresponding to chrome and alumina exhaustions of 98.4% and 90% respectively.

The skins were washed, neutralised, dyed and fat liquored in a conventional manner to give flat skins with a good suede and tight nap.

EXAMPLE 9

Six English sheepskins (weight 4.2 Kg) degreased and pickled were drummed in a 150% float of 6% brine for fifteen minutes. After drumming liquor pH was 2.7.

Reactive alumina hydrate, 146 g, (12% $Al_2O_3$ prepared as in Example 6) was added and drummed in for 3 hours (alumina offer 0.42%).

A proprietary sulphate masked basic chromium sulphate powder (25% $Cr_2O_3$ 33% basicity) 210 g, was added and drummed in for one hour. A further 146 g of reactive alumina hydrate was then added to make a total alumina offer of 0.83% on pickled weight and chrome offer of 1¼%.

During the first 7 hours, the liquor temperature was gradually raised to 35° C. Drumming continued overnight without heat. Final liquor pH was 3.4.

Leather was obtained with a shrinkage temperature of over 100° C. The exhausted liqor was analysed as in Example 1 and found to contain 0.63 $gdm^{-3}$ $Cr_2O_3$ and 0.59 $gdm^{-3}$ $Al_2O_3$ corresponding to chrome and alumina exhaustions of 89% and 80% respectively.

The skin were washed, neutralised, dyed and fat liquored in a conventional manner to give flat skins with good suede and a tight nap.

EXAMPLE 10

Six degreased pickled English sheepskins (weight 4.2 Kg) were drummed in a 150% float of 6% brine for 15 minutes, after drumming liquor pH was 2.7.

A proprietary sulphate masked basic chromic sulphate powder (25% $Cr_2O_3$, 33% basicity), 210 g, was added and drummed in for one hour.

Reactive alumina hydrate, 292 g, (12% $Al_2O_3$ prepared as in Example 6) was added making an alumina offer of 0.83%.

Drumming was continued for 6 hours with gradual heating to 35° C. Drumming continued overnight at 35° C. Final liquor pH was 3.3.

Leather was obtained with a shrinkage temperature of 99° C. The exhausted liquor was analysed as in Example 1 and found to contain 0.21 $gdm^{-3}$ $Cr_2O_3$ and 0.69 $gdm^{-3}$ $Al_2O_3$ corresponding to chrome and alumina exhaustions of 96% and 77% respectively.

The skins were washed, neutralised, dyed and fat liquored in a conventional manner to give flat skins with good suede and a tight nap.

EXAMPLE 11

Two lime split, degreased ox sides (23 Kg pack weight) were drummed in a 150% float of 8% brine. Formic acid, 220 ml was added over a period of two hours to lower the liquor pH from 6.3 to 3.3. Bromocresyl green applied to cut samples showed even penetration of pickle into the hides.

A proprietary sulphate masked basic chromium sulphate powder (25% $Cr_2O_3$, 33% basicity) 1.15 Kg, was added this representing 1¼% $Cr_2O_3$ offer on the pack weight. Drumming continued for one hour at room temperature when the liquor pH was 3.2 and the leather showed good penetration of chrome liquor.

Reactive alumina hydrate, 1.72 g, 11% $Al_2O_3$ (prepared as in Example 6) was added representing an alumina offer of 0.83%.

Drumming was continued at room temperature overnight, after twenty one hours tanning a shrinkage temperature of 98° C. was achieved; liquor pH was 4.0.

The exhausted liquor was analysed as described in Example 1 and found to contain 0.35 $gdm^{-3}$ $Cr_2O_3$ and 0.40 $gdm^{-3}$ $Al_2O_3$ corresponding to chrome and alumina exhaustions of 96% and 93% respectively.

The leather was washed, neutralised and finished at a commercial tannery in a standard commercial process. Good quanlity flat leather was obtained with even dying and slightly firmer texture than the standard all chrome product.

EXAMPLE 12

Four lime split, degreased, pickled ox hides were drummed in a 150% float of 8% brine for one hour. Formic acid 150 ml was added to reduce the pH from 3.7 to 3.2; good penetration was achieved of the pickle.

Reagent quantities were based on the original lime split weight. A proprietary sulphate masked basic chromium sulphate powder (25% $Cr_2O_3$, 33% basicity) 2.85

Kg, was added and drummed in for one hour at room temperature representing a $1\frac{1}{4}$% offer of chrome on the original lime split weight (22.8 Kg). At this stage the pH was 3.2. A liqud float of 150% (34) was used.

Reactive alumina hydrate, 4.75 Kg, 10% $Al_2O_3$ (prepared as in Example 6) was added representing an alumina offer of 0.83% based on limed split weight. Drumming was continued for 5 hours the temperature being gradually raised from 21° C. to 35° C. over the first three hours and left drumming overnight without heat.

Final liquor pH was 3.8, the shrinkage temperature was over 100° C. and the leather also passed the more stringent boil test.

Final liquor was analysed as described in Example 1 and found to contain 0.9 $gdm^{-3}$ $Cr_2O_3$ and 1.51 $gdm^{-3}$ $Al_2O_3$ corresponding to chrome and alumina exhaustions of 89% and 73% respectively.

EXAMPLE 3

A standard chrome tannage was carried out on six English, degrased, pickled sheepskins with spray dried proprietary basic chromium sulphate powder (25% $Cr_2O_3$ 33% basicity) and sodium bicarbonate.

Six degreased and pickled sheepskins (4.45 Kg) were drummed in 4.45 $dm^{-3}$ water containing 266 g basic chromium sulphate (25% $Cr_2O_3$ 33% basicity) drumming was continued for one hour at a constant 40° C.

Aliquots of sodium bicarbonate ("AnalaR") were added over the next five hours drumming to a total of 110 g. The final pH was pH 3.85 compared to pH 2.0 at the end of the first hour. The exhausted liquor was subject to analysis by atomic absorption spectroscopy and found to contain 1.2 $gdm^{-3}$ $Cr_2O_3$ corresponding to chrome exhaustion of 92%. The shrinkage temperature of the leather was measured by immersion of wet skin in paraffin as described in B.S.3144 1968 p56; the paraffin replacing water for shrinkage temperatures over 100° C.

A shrinkage temperature of 100° C. was obtained for these skins for a $1\frac{2}{3}$% chrome offer but they failed the boil test of BS 3144.

A mixed chrome-aluminium tannage was carried out as follows with offers of ($1\frac{1}{2}$ $Cr_2O_3$ and 1.4% $Al_2O_3$).

Six degreased and pickled sheepskins (5.65 Kg) from the same pack as above were drummed for one hour in 5.65 $dm^{-3}$ water containing 339 g basic chromium sulphate (25% $Cr_2O_3$ 33% basicity) at a constant 40° C. Reactive alumina hydrate (5% $Al_2O_3$ prepared as described in Example 6) was added at half hourly intervals in 150 g–300 g aliquots to a total of 1600 g (1.42% $Al_2O_3$ offer).

The final liquor pH was 3.4 after a total tanning time of 6 hours compared with 2.0 after the first hour. The exhausted liquor was subject to analysis by atomic absorption spectroscopy and found to contain 1.6 $gdm^{-3}$ $Cr_2O_3$ and 0.95 $gdm^{-3}$ $Al_2O_3$ corresponding to chrome and alumina exhaustions of 89% and 93% respectively. The shrinkage temperature of the tanned skins was measured as described aove and found to be 111° C. despite marginally lower chrome exhaustion due to lower final pH.

It may be seen from these results that substantially all the chromium and aluminium was taken up from the solutions to which reactive alumina hydrate was added, rendering the exhaused solutions substantially harmless as effluent. The properties of the leather, such as stability to shrinkage at elevated temperatures, were improved for a given offer of chromium when the alumina hydrate was added because of the increased take-up of chromium and the tanning effect of the absorbed aluminium ionic species.

The tanning effect of the aluminium also allowed a given degree of tanning to be achieved with a lower amount of chromium absorbed by the leather, allowing a whiter leather to be obtained for a given degree of tanning.

I claim:

1. In a method of tanning skins and hides which comprises treating the skin or hide with an aqueous solution containing a chromium compound to tan the skin or hide, the improvement which comprises adding to the solution a material consisting of reactive alumina hydrate to increase the pH of the solution to a value not exceeding about 4.5.

2. A method according to claim 1, in which the reactive alumina hydrate is added to the solution after an initial pre-tanning with the solution of the chromium compound.

3. A method according to claim 2, in which the reactive alumina hydrate is added to the solution after an initial pre-tanning of about 1 hour duration.

4. A method according to claim 1, in which the reactive alumina hydrate is added to the solution stepwise at intervals.

5. A method according to claim 1 in which the reactive alumina hydrate is added to the solution in a single addition step.

6. A method according to claim 1, in which the reactive alumina hydrate is added as an aqueous slurry containing from 0.1 to 12% by weight of alumina measured as anhydrous $Al_2O_3$.

7. A method according to claim 1, in which the reactive alumina hydrate is added as a powder comprising from 20 to 90% by weight of alumina measured as anhydrous $Al_2O_3$.

8. A method according to claim 1, in which the reactive alumina hydrate is added as a filter cake containing from 2 to 25% by weight of alumina measured as anhydrous $Al_2O_3$.

9. A method according to claim 1, in which the solution contains from 1 to 50 g/l of chromium measured as chromic oxide at the start of tanning.

10. A method according to claim 1, in which the chromium content of the solution at the start of tanning, measured as chromic oxide, is from 0.1 to 7% of the weight of the skin or hide and the amount of reactive alumina hydrate added, measured as anhydrous $Al_2O_3$, is from 0.1% to 10% of the pickled weight of the skin or hide.

11. Leather, when made by tanning hides or skins by a method according to claim 1.

12. A method according to claim 3, in which the reactive alumina hydrate is added to the solution stepwise at intervals.

13. A method according to claim 2, in which the reactive alumina hydrate is added to the solution in a single addition step.

14. A method according to claim 12, in which the reactive alumina hydrate is added as an aqueous slurry containing from 0.1 to 12% by weight of alumina measured as anhydrous $Al_2O_3$.

15. A method according to claim 13, in which the reactive alumina hydrate is added as an aqueous slurry containing from 0.1 to 12% by weight of alumina measured as anhydrous $Al_2O_3$.

16. A method according to claim 13, in which the reactive alumina hydrate is added as a powder comprising from 20 to 90% by weight of alumina measured as anhydrous $Al_2O_3$.

17. A method according to claim 13, in which the reactive alumina hydrate is added as a filter cake containing from 2 to 25% by weight of alumina measured as anhydrous $Al_2O_3$, and wherein the solution contains from 1 to 50 g/l of chromium measured as chromic oxide at the start of tanning.

18. A method according to claim 16, in which the chromium content of the solution at the start of tanning, measured as chromic oxide, is from 0.1 to 7% of the weight of the skin or hide and the amount of reactive alumina hydrate added, measured as anhydrous $Al_2O_3$, is from 0.1% to 10% of the pickled weight of the skin or hide.

19. A method according to claim 12, in which the reactive alumina hydrate is added as a powder comprising from 20 to 90% by weight of alumina measured as anhydrous $Al_2O_3$.

20. In a method of tanning skins and hides which comprises treating the skin or hide with an aqueous solution consisting essentially of a chromium compound to tan the skin or hide, the improvement which comprises:

adding a material consisting of reactive alumina hydrate to the solution, said reactive alumina hydrate being a hydrate of alumina capable of dissolving in aqueous solutions having a pH value of about 3 at temperatures below 50° C. to neutralize some of the acidity and increase the pH value, dissolving said reactive alumina hydrate in the aqueous tanning solution and thereby forming water soluble aluminum salts and effecting an increase in the pH value, thereby causing the chromium compound to generate protons and polymerizing unitl an equilibrium is established, and forming a complex of chromium aluminum-hydroxy ions, continuing tanning while the pH of the aqueous tanning solution increases to a greater than normal value up to a maximum of 4.5, and continuing tanning until the chromium is substantially exhausted.

* * * * *